United States Patent [19]

Mohr

[11] 4,427,766

[45] Jan. 24, 1984

[54] HYDROPHILIC COATING OF SALT TYPE NITROGEN POLYMER ON ALUMINUM SUPPORT MATERIALS FOR OFFSET PRINTING PLATES AND PROCESS FOR MANUFACTURE AND USE WITH LIGHT SENSITIVE LAYER THEREON

[75] Inventor: Dieter Mohr, Wiesbaden, Fed. Rep. of Germany

[73] Assignee: Hoechst Aktiengesellschaft, Frankfurt am Main, Fed. Rep. of Germany

[21] Appl. No.: 391,154

[22] Filed: Jun. 23, 1982

[30] Foreign Application Priority Data

Jul. 6, 1981 [DE] Fed. Rep. of Germany ..... 3126626

[51] Int. Cl.[3] ..... C23C 1/08; G03C 1/94; B41N 1/08

[52] U.S. Cl. ..... 430/525; 148/6.27; 204/17; 204/35 R; 204/35 N; 204/38 E; 204/58; 427/388.1; 427/409; 430/49; 430/60; 430/158; 430/160; 430/166; 430/167; 430/276; 430/278; 430/264; 430/302; 430/526

[58] Field of Search ..... 430/160, 167, 166, 276, 430/302, 49, 60, 264, 278, 525, 526, 158; 148/6.27; 427/388.1, 409; 204/17, 35 R, 35 N, 38 E, 58

[56] References Cited

U.S. PATENT DOCUMENTS

| | | | |
|---|---|---|---|
| 2,714,066 | 7/1955 | Jewett et al. . | |
| 3,131,630 | 5/1964 | Spencer | 101/149.2 |
| 3,163,534 | 12/1964 | Adams et al. | 430/160 |
| 3,181,461 | 5/1965 | Fromson . | |
| 3,232,783 | 2/1966 | Deal et al. . | |
| 3,261,285 | 7/1966 | Sorkin | 101/149.2 |
| 3,276,868 | 10/1966 | Uhlig . | |
| 3,280,734 | 10/1966 | Fromson . | |
| 3,281,243 | 10/1966 | Sorkin et al. | 96/86 |
| 3,298,852 | 1/1967 | Beatty et al. . | |
| 3,440,050 | 4/1969 | Chu . | |
| 3,672,885 | 6/1972 | Ort . | |
| 3,672,966 | 6/1972 | Geisler et al. . | |
| 3,733,200 | 5/1973 | Takaishi et al. . | |
| 3,769,043 | 10/1973 | Morishima et al. . | |
| 3,859,099 | 1/1975 | Petropoulos et al. | 430/190 |
| 3,860,426 | 1/1975 | Cunningham et al. . | |
| 3,861,917 | 1/1975 | Magnotta et al. . | |
| 3,900,370 | 8/1975 | Germscheid et al. . | |
| 3,902,976 | 9/1975 | Walls . | |
| 4,045,599 | 8/1977 | Remaley et al. | 148/6.27 |
| 4,049,746 | 9/1977 | Muzyczko et al. . | |
| 4,136,073 | 1/1979 | Muro et al. | 148/6.27 |
| 4,153,461 | 5/1979 | Berghauser et al. . | |
| 4,208,212 | 6/1980 | Kuzuwata et al. . | |

FOREIGN PATENT DOCUMENTS

| | | |
|---|---|---|
| 2834958 | 2/1980 | Fed. Rep. of Germany . |
| 39-23982 | 10/1939 | Japan . |
| 894186 | 4/1962 | United Kingdom . |
| 895276 | 5/1962 | United Kingdom . |
| 907718 | 10/1962 | United Kingdom . |
| 1246696 | 1/1970 | United Kingdom . |
| 1414575 | 11/1975 | United Kingdom . |

OTHER PUBLICATIONS

Chemical Abstracts, vol. 93, 1980, #58253w (Bergehaeuser et al.).

*Primary Examiner*—Charles L. Bowers, Jr.
*Attorney, Agent, or Firm*—Schwartz, Jeffery, Schwaab, Mack, Blumenthal & Koch

[57] ABSTRACT

The plate-, foil- or strip-shape support materials for offset printing plates are based on chemically, mechanically and/or electromechanically roughened aluminum, or on one of its alloys. Optionally, the aluminum may also have an aluminum oxide layer produced by anodic oxidation. One of the two surfaces of the support material has a hydrophilic coating of at least one salt-type hydrophilic organic polymer which is a complex-type product obtained by reacting (a) a water-soluble organic polymer having carboxylate substituents, carboxylic acid amide substituents and/or carboxylic acid imide substituents as functional groups, with (b) a salt of an at least divalent metal cation, and wherein the quantity of complex-type reaction product is less than about 0.1 mg per $dm^2$ of support material surface.

In a process for manufacturing this support material, the complex-type reaction product, dissolved in an aqueous acid, is applied to at least one surface of the support material and the support material thus modified is dried. It is also possible, however, to produce the complex-type reaction product of the components (a) and (b) on the support material. The support material is used in the preparation of offset printing plates having a light-sensitive layer.

14 Claims, No Drawings

HYDROPHILIC COATING OF SALT TYPE NITROGEN POLYMER ON ALUMINUM SUPPORT MATERIALS FOR OFFSET PRINTING PLATES AND PROCESS FOR MANUFACTURE AND USE WITH LIGHT SENSITIVE LAYER THEREON

BACKGROUND OF THE INVENTION

The present invention relates to plate-, foil- or strip-shape support materials for offset printing plates, wherein the materials are based on aluminum having a hydrophilic coating. The present invention also relates to a process for the manufacture of these materials, and to the use of the materials in the preparation of offset printing plates.

Support materials for offset printing plates, prepared either by the consumer directly or by the manufacturer of pre-coated printing plates, are provided on one or both sides with a light-sensitive layer (copying layer), with the aid of which an image of an original is photomechanically produced. When the printing form has been prepared, the support carries the ink-receptive image areas and at the same time forms, in the image-free areas (non-image areas), the water-receptive image background for the lithographic printing process.

A support for light-sensitive material for preparing lithographic plates therefore must meet the following requirements:

The parts of the light-sensitive layer which have become relatively more soluble after exposure must be readily removable from the support by developing, without leaving a residue, in order to produce the hydrophilic non-image areas.

The support bared in the non-image areas must have great affinity for water, i.e., it must be strongly hydrophilic, to take up water rapidly and permanently in the lithographic printing process and to have an adequate repellent effect toward the oily printing ink.

The light-sensitive layer before exposure and the printing parts of the layer after exposure must adhere to a sufficient extent to the support.

The base material used for supports of this type can be aluminum, steel, copper, brass or zinc foils, and in addition, also plastic film or paper. These raw materials can be converted into supports for offset printing plates, for example, by graining, dull chromium plating, surface oxidation and/or application of an intermediate layer. Aluminum, today probably the most frequently used base material for offset printing plates, is surface-roughened by known methods using dry brushing, wet brushing, sand blasting or chemical and/or electrochemical treatment. To increase the abrasion resistance, the roughened substrate can be additionally subjected to an anodizing step to build up a thin oxide layer.

In practice, the support materials, in particular anodically oxidized support materials based on aluminum, are in many cases subjected to a further treatment step before application of a light-sensitive layer, in order to improve the layer adhesion, to increase the hydrophilic character and/or to facilitate the developability of the light-sensitive layers. These treatment steps include, for example, the following methods:

In German Pat. No. 907,147 (=U.S. Pat. No. 2,714,066), German Auslegeschrift No. 1,471,707 (=U.S. Pat. No. 3,181,461 and 3,280,734) or German Offenlegungsschrift No. 2,532,769 (=U.S. Pat. No. 3,902,976), processes are described for rendering hydrophilic printing plate support materials based on optionally anodically oxidized aluminum. In those processes, the materials are treated with aqueous sodium silicate solution, either without or with the use of electric current.

It is known from German Pat. No. 1,134,093 (=U.S. Pat. No. 3,276,868) and German Pat. No. 1,621,478 (=U.S. Pat. No. 4,153,461), to use polyvinylphosphonic acid or copolymers based on vinylphosphonic acid, acrylic acid and vinyl acetate to render hydrophilic printing plate support materials based on optionally anodically oxidized aluminum. The use of salts of these compounds is also mentioned but not specified in more detail.

The use of complex fluorides of titanium, zirconium or hafnium, in accordance with German Auslegeschrift No. 1,300,415 (=U.S. Pat. No. 3,440,050), also additionally renders hydrophilic aluminum oxide layers on printing plate support materials.

In addition to these hydrophilizing methods which have become particularly well known, the use of, for example, the following polymers in this area of application has also been described:

German Auslegeschrift No. 1,056,931 describes the use of water-soluble, linear copolymers based on alkyl vinyl ethers and maleic anhydrides in light-sensitive layers for printing plates. Of these copolymers, particularly hydrophilic are those in which the maleic anhydride component is reacted incompletely, or more or less completely, with ammonia, an alkali metal hydroxide or an alcohol.

German Auslegeschrift No. 1,091,433 describes how printing plate support materials based on metals are rendered hydrophilic by means of film-forming organic polymers such as polymethacrylic acid or sodium carboxymethylcellulose or sodium hydroxyethylcellulose, in the case of aluminum supports, or by means of copolymers of methyl vinyl ether and maleic anhydride, in the case of magnesium supports.

To render hydrophilic printing plate support materials made of metals, in accordance with German Auslegeschrift No. 1,173,917 (=British Pat. No. 907,718), initially water-soluble polyfunctional amino-urea-aldehyde synthetic resins or sulfonated urea-aldehyde synthetic resins are used, which are then hardened on the metal support to form a water-insoluble state.

To prepare a hydrophilic layer on printing plate support materials, according to German Auslegeschrfit No. 1,200,847 (=U.S. Pat. No. 3,232,783), first (a) an aqueous dispersion of a modified urea-formaldehyde resin of an alkylated methylol-melamine resin or of a melamine-formaldehyde-polyalkylenepolyamine resin is applied to the support, whereupon (b) an aqueous dispersion of a polyhydroxy or polycarboxy compound such as sodium carboxymethylcellulose is applied, and finally the substrate thus coated is (c) treated with an aqueous solution of a Zr, Hf, Ti or Th salt.

German Auslegeschrift No. 1,257,170 (=U.S. Pat. No. 2,991,204) describes, as an agent for rendering printing plate support materials hydrophilic, a copolymer which, in addition to acrylic acid, acrylate, acrylamide or methacrylamide units, also contains Si-trisubstituted vinylsilane units.

German Offenlegungsschrift No. 1,471,706 (=U.S. Pat. No. 3,298,852) describes the use of polyacrylic acid as an agent for rendering hydrophilic printing plate support materials made of aluminum, copper or zinc.

The hydrophilic layer on a printing plate support material in accordance with German Pat. No. 2,107,901 (=U.S. Pat. No. 3,733,200) is formed from a water-insoluble hydrophilic acrylate or methacrylate homopolymer or copolymer having a water absorption of at least 20% by weight.

To densify anodically oxidized aluminum surfaces, according to German Offenlegungsschrift No. 2,211,553 (=U.S. Pat. No. 3,900,370), a process is used in which, at a temperature of at least 90° C. and at a pH value of 5 to 6.5, a solution is applied which contains water-soluble phosphonic acids which form complexes with divalent metals, or salts of these acids (such as 1-hydroxyethane-1,1-diphosphonic acid or aminotrimethylenephosphonic acid), and $Ca^{2+}$ ions; these solutions can also additionally contain dextrins.

German Auslegeschrift No. 2,305,231 (=British Pat. No. 1,414,575) describes a method for rendering hydrophilic printing plate support materials in which method a solution or dispersion of a mixture of an aldehyde and of a synthetic polyacrylamide is applied to the support.

German Offenlegungsschrift No. 2,308,196 (=U.S. Patent No. 3,861,917) describes a method for rendering hydrophilic roughened and anodically oxidized aluminum printing plate supports by using ethylene- or methyl vinyl ether-maleic anhydride copolymers, polyacrylic acid, carboxymethylcellulose, sodium poly(vinylbenzene-2,4-disulfonic acid) or polyacrylamide.

German Auslegeschrift No. 2,364,177 (=U.S. Pat. No. 3,860,426) describes a hydrophilic adhesive layer for aluminum offset printing plates which is arranged between the anodically oxidized surface of the printing plate support and the light-sensitive layer and which, in addition to a cellulose ether, additionally contains a water-soluble Zn, Ca, Mg, Ba, Sr, Co or Mn salt. The layer weight of the cellulose ether in the hydrophilic adhesive layer is 0.2 to 1.1 mg/dm$^2$, the same layer weight being indicated also for the water-soluble salts. The mixture of cellulose ether and salt is applied to the support in aqueous solution, optionally with the addition of an organic solvent and/or a surfactant.

To densify anodically oxidized aluminum surfaces, according to U.S. Pat. No. 3,672,966, after the surfaces have been sealed, aqueous solutions of acrylic acid, polyacrylic acid, polymethacrylic acid, polymaleic acid or copolymers of maleic acid with ethylene or vinyl alcohol are used.

According to U.S. Pat. No. 4,049,746, the agents used for rendering hydrophilic printing plate support materials contain salt-like products obtained from reacting water-soluble polyacrylic resins having carboxyl groups with polyalkyleneimine-urea-aldehyde resins.

British Pat. No. 1,246,696 describes, as agents for rendering hydrophilic anodically oxidized aluminum printing plate supports, hydrophilic colloids such as hydroxyethylcellulose, polyacrylamide, polyethylene oxide, polyvinylpyrrolidone, starch or gum arabic.

Japanese Preliminary Published Application No. 64/23,982 describes how metal printing plate supports are rendered hydrophilic by means of polyvinylbenzenesulfonic acid.

For use in rendering hydrophilic printing plate support materials, the state of the art also describes metal complexes which are such that they have low-molecular ligands and include, for example:

complex ions of divalent or polyvalent metal cations and ligands such as ammonia, water, ethylenediamine, nitrogen oxide, urea or ethylenediamine tetraacetate, according to German Offenlegungsschrift No. 2,807,396 (=U.S. Pat. No. 4,208,212), ferric cyanide complexes, such as $K_4[Fe(CN)_6]$ or $Na_3[Fe(CN)_6]$, in the presence of heteropoly acids, such as phosphomolybdic acid, or their salts and of phosphates, according to U.S. Pat. No. 3,769,043 or ferric cyanide complexes in the presence of phosphates and complex formers such as ethylenediamine tetraacetic acid for electrophotographic printing plates having a zinc oxide surface, according to Dutch Preliminary Published Application No. 68/09,658 (=U.S. Pat. No. 3,672,885).

However, all the methods described above have more or less great disadvantages, so that the resulting support materials in many cases no longer satisfy current offset printing requirements for the following reasons:

Thus, after the treatment with alkali metal silicates, which lead to good developability and hydrophilic character, a certain deterioration of the shelf life of light-sensitive layers applied thereto must be accepted.

Although the complexes of transition metals, in principle, enhance the hydrophilic character of anodically oxidized aluminum surfaces, the complexes have the disadvantage that they are very readily soluble in water, with the result that they can be readily removed when the layer is developed with aqueous developer systems which of late contain to an increasing extent surfactants and/or chelating agents which have high affinity for these metals. This more or less strongly reduces the concentration of transition metal complexes on the surface and can thus lead to attenuation of the hydrophilic effect.

In the treatment of supports with water-soluble polymers, the ready solubility of the latter, particularly in aqueous alkaline developers of the type predominantly used for developing positive-working light-sensitive layers, likewise causes marked attenuation of the hydrophilicity-imparting effect.

In the case of polymers containing carboxylic acid groups, the fact that free carboxylate functions can interact with the diazo cations of negative-working light-sensitive layers has a noticeable adverse effect, so that, after developing with developers containing organic solvents, a marked yellow haze due to retained diazo compounds remains in the non-image areas.

The combination of a mixture of a water-soluble polymer, such as a cellulose ether, and a water-soluble metal salt also leads to reduced adhesion of the layer, since the layer weights and hence the layer thickness are chosen to be relatively high (see German Auslegeschrift No. 2,364,177). This can manifest itself, for example, by the fact that, in developing, some of the developer liquid migrates underneath image areas.

SUMMARY OF THE INVENTION

It is therefore an object of the present invention to provide an improved support material for offset printing plates.

Another object is to provide an improved process for manufacturing the support material according to the invention for offset printing plates.

It is also an object of the invention to modify support materials for offset printing plates in such a way with respect to their hydrophilic character that these materials are equally suitable for use as supports for positive- and negative- or electrophotographic-working light-sensitive layers, without resulting in the above-mentioned disadvantages of known modifying methods.

Still another object of the invention resides in providing an improved offset printing plate and method of using same.

In accomplishing the foregoing objects, there has been provided in accordance with the present invention a web-shape support material for offset printing plates, comprising a base layer comprised of aluminum or aluminum alloy and having a roughened surface, and a hydrophilic coating of at least one salt-type hydrophilic organic polymer on the roughened surface of the base layer, wherein the salt-type hydrophilic organic polymer comprises a complex-type product obtained by reacting (a) a water-soluble organic polymer having carboxylate substituents, carboxylic acid amide substituents and/or carboxylic acid imide substituents as functional groups, with (b) a salt of an at least divalent metal cation, and wherein the quantity of complex-type reaction product is less than about 0.1 mg per $dm^2$ of support material surface. Preferably, the water-soluble organic polymer comprises polyacrylic acid; a copolymer based on polyacrylic acid; polyacrylamide; a hydrolyzed copolymer based on ethylene or vinylmethyl ether and maleic acid anhydride; a copolymer which has been partly or completely subjected to an ammonolysis with $NH_3$ and is based on ethylene or vinylmethyl ether and maleic acid anhydride; carboxyalkyl cellulose or the mixed ethers thereof; or one of the salts of these polymers with a monovalent cation and the metal cation comprises $Bi^{3+}$, $Al^{3+}$, $Fe^{3+}$, $Zr^{4+}$, $Sn^{4+}$, $Ca^{2+}$, $Ti^{3+}$, $Ba^{2+}$, $Sr^{2+}$, $Co^{2+}$, $Fe^{2+}$, $Mn^{2+}$, $Ni^{2+}$, $Cu^{2+}$, $Zn^{2+}$, or $Mg^{2+}$.

There has also been provided according to the present invention a process for manufacturing the support material for offset printing plates as described above, comprising the steps of applying a solution of the complex-type reaction product in an aqueous acid to at least one surface of the base layer, and drying the support material thus modified. The solution of the complex-type reaction product can either be prepared beforehand and applied to the base layer, or the complex-type reaction product of the components (a) and (b) can be formed on the support material.

In accordance with still another aspect of the invention, there has been provided an offset printing plate, comprising a support material as defined above, and a layer of a light-sensitive material coated on the support material.

Further objects, features and advantages of the present invention will become apparent from the detailed description of preferred embodiments which follows.

DETAILED DESCRIPTION OF PREFERRED EMBODIMENTS

The invention starts from known plate-, foil- or strip-shape support materials for offset printing plates, which materials are based on chemically, mechanically and/or electrochemically roughened aluminum or one of its alloys, which optionally has an aluminum oxide layer produced by anodic oxidation. The material has a hydrophilic coating of at least one salt-type hydrophilic organic polymer on at least one surface of the support material. In the support materials according to the invention, the salt-type hydrophilic organic polymer is a complex-type product obtained by reacting (a) a water-soluble organic polymer with carboxylate substituents, carboxylic acid amide substituents and/or carboxylic acid imide substituents as functional groups, with (b) a salt of an at least divalent metal cation, and wherein the quantity of complex-type reaction product is less than about 0.1 mg per $dm^2$ of support material surface. In the complex-type reaction products, 1 to 3, preferably 2, coordination sites of the metal cation are occupied by the functional groups of the polymer, which probably acts as a chelate ligand.

The water-soluble polymers used for producing the complex-type reaction products particularly include polyacrylic acid; a copolymer based on polyacrylic acid; polyacrylamide; a copolymer based on polyacrylamide; a copolymer which has been hydrolyzed or partly or completely subjected to an ammonolysis with $NH_3$ and is based on ethylene or vinylmethylether and maleic anhydride; or carboxyalkyl cellulose having alkyl groups from $C_1$ to $C_3$, in particular carboxymethyl cellulose, or the mixed ethers thereof, such as carboxymethyl hydroxyethyl cellulose.

To prepare the complex-type reaction products, the metal cations are generally used in the form of their salts with mineral acid anions or as acetates. In this reaction, the di-, tri- or tetravalent, in particular the divalent, cations are preferable. The cations are in particular $V^{5+}$, $Bi^{3+}$, $Al^{3+}$, $Fe^{3+}$, $Zr^{4+}$, $Sn^{4+}$, $Ca^{2+}$, $Ba^{2+}$, $Sr^{2+}$, $Ti^{3+}$, $Co^{2+}$, $Fe^{2+}$, $Mn^{2+}$, $Ni^{2+}$, $Cu^{2+}$, $Zn^{2+}$, or $Mg^{2+}$ ions.

In the complex-type reaction products according to the invention, the metal cation, not only in an aqueous solution but also in the solid state, is present as a rule as an octahedral complex, in which preferably two of the six coordination sites are occupied by the functional groups of the polymer and the four remaining coordination sites are occupied by anions of the salt used, hydroxyl ions, amine ligands and to a predominant extent by water or completely by water. These products, depending on the metal cation, are soluble in more or less acid media and are quantitatively precipitated on neutralization of the acid solution with an alkali metal hydroxide or ammonia. These products are insoluble in neutral or alkaline aqueous solvents and in customary organic solvents.

These complex-type reaction products can be prepared in a simple manner in an aqueous solution at temperatures of 20° to 100° C., preferably at 25° to 40° C. In the case of copolymers containing maleic anhydride components, higher temperatures of, e.g., more than 80° C., are initially required for the hydrolysis of the copolymers. A solution of the metal salt in water, or, if necessary, in a dilute mineral acid, is slowly added dropwise to the aqueous polymer solution. In this step, the immediate conversion of the reaction components to the products described above commences. The rapid commencement of reaction is manifested—depending on the metal cation used—in an immediately occurring color change of the solution or by the formation of a precipitate. The driving force of these reactions presumably is the chelate effect (see, for example, F. A. Cotton and G. Wilkinson, "Anorganische Chemie [Inorganic Chemistry]", 3rd edition, Verlag Chemie-Weinheim, 1974, pages 689/690). For purification, the products can be precipitated by neutralizing the reaction solution with dilute alkali metal hydroxide or ammonia solutions, during which step unconverted starting products remain in the solution. The yields of these reactions are above 90%. Instead of the acid forms described of the polymers, it is also possible to use their salt forms with a univalent cation, such as the sodium salt or ammonium salt.

The chemical structure of the polymer-metal complexes according to the invention can be illustrated as follows:

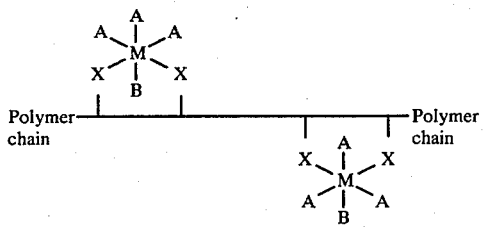

in which, in particular, X denotes $COO^-$, M denotes the central ion, and in the case of 2-valent metal cations A=B denote $H_2O$ or in the case of 3-valent metal cations A denotes $H_2O$ and B denotes $NO_3^-$, $Cl^-$, $HSO_4^-$, $H_2PO_4^-$, $CH_3COO^-$, $OH^-$ or similar anions. If X denotes $CONH_2$, the charge of the central ion M is saturated by 2 or 3 ligands B.

The structure indicated is likely to exist mainly in acid solutions. Upon adding aqueous alkali metal hydroxide or ammonia solutions, a large number of ligand exchange reactions are possible on such complexes. An example of the broad variety of possible exchange reactions of this type is given in the following scheme by means of the $Co^{2+}$ complex of the ethylene/maleic acid copolymers:

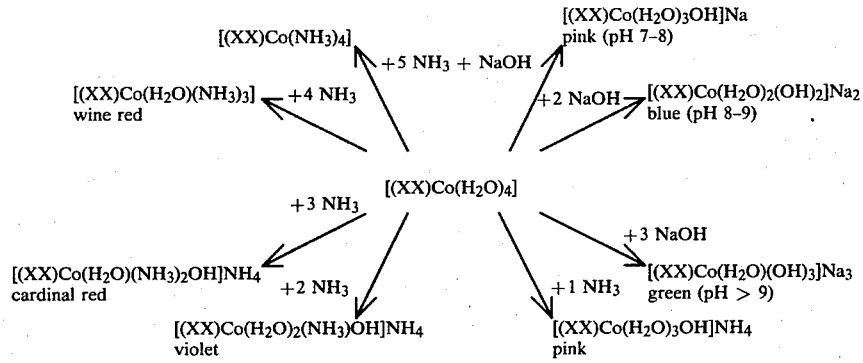

This scheme is by no means intended to be complete, since, in addition to the indicated exchange reactions, the metal salt anions present in the reaction solution may also be introduced into the sphere of coordination of the metal ion, or changes in the stage of oxidation of the metal ion may occur. Other complex-type reaction products according to this invention react in a way which is specific for the individual metal cation and/or complex, similar to the exemplary illustration using the $Co^{2+}$ complex.

To treat the substrates in the manufacture of the support materials according to the invention for offset printing plates, the isolated and dried complex-type reaction products are preferably dissolved in about 0.1 to 10% strength, in particular about 0.5 to 3% strength, mineral acids, preferably phosphoric acid, in concentrations of from about 0.05 to 5%, in particular in concentrations of from about 0.1 to 1%.

The treatment of these substrates with the solutions of the complex-type reaction products is advantageously carried out by dipping cut-to-size sheets or by passing the substrate strip through a bath of these solutions. In this step, temperatures of from about 20° to 95° C., preferably of from about 25° to 60° C., and residence times of from about 2 sec. to 10 min., preferably of from about 10 sec. to 3 min., prove most advantageous for practical use. Increasing the bath temperature favors chemisorption of the polymer-metal complexes on the substrate. This makes it possible, in particular in the case of a continuous strip treatment, to reduce residence times considerably. The dipping treatment is then advantageously followed by a rinsing step with water, mainly with tap water. This rinsing process, on the one hand, can have the purpose of removing excess treatment solution from the support, while, on the other hand, acid treatment solution present on the support is shifted by the dilution with water so strongly in the direction of the neutral point that the dissolved complexes can precipitate in the pores of the substrate and hence become firmly fixed to the support. The substrate thus treated is then advantageously dried at temperatures of from about 110° to 130° C.

The treatment of the aluminum substrate may also be carried out in a two-stage process. In the first stage, the substrate is, for example, dipped into an about 0.2 to 10%, preferably about 0.5 to 5% strength aqueous solution of the basic polymer. Thereafter the substrate can, without rinsing or drying, be passed through a second bath containing a 0.1% to saturated, preferably from about 0.5 to 10% strength aqueous salt solution of the polyvalent metal ions listed above. Rinsing and drying are then performed as in the one-stage process described before. In the two-stage treatment, the complex-type reaction products on the substrate which have been described above, are formed during the treatment. By this process variant it is made possible to apply even the complex-type reaction products of trivalent metal ions to the substrate, which are only sparingly soluble in strongly acid media.

Determination of the weight of the hydrophilic coating of the complex-type reaction product applied is associated with problems, since already small amounts of the applied product have marked effects and are anchored relatively strongly in and on the surface of the support material. However, it can be assumed that the amount applied is markedly below 0.1 mg/dm$^2$, in particular below 0.08 mg/dm$^2$.

The layer weight can be determined by weighing, for example, an aluminum foil which may consist of, for example, electrochemically roughened and anodically oxidized aluminum having a thickness of 0.03 mm, and then treating this foil in the above described way. The weight increases measured after drying are particularly in a range of between 4 and 8 mg/m$^2$ (0.04 to 0.08 mg/dm$^2$), depending on the nature of the complex-type reaction product.

The support materials according to the invention thus manufactured can then be coated with various light-sensitive layers to prepare offset printing plates.

Suitable substrates for the manufacture of the support materials according to the invention include those made of aluminum or one of its alloys. They include, for example:

"Reinaluminium [Pure aluminum]" (DIN material No. 3.0255), i.e., comprised of ≧99.5% of Al and the following permissible impurities of (maximum total of 0.5%) 0.3% of Si, 0.4% of Fe, 0.03% of Ti, 0.02% of Cu, 0.07% of Zn and 0.03% of others, or "Al-Legierung 3003 [Al alloy 3,003 ]" (comparable with DIN material No. 3.0515), i.e., comprised of ≧98.5% of Al, the alloy constituents 0 to 0.3% of Mg and 0.8 to 1.5% of Mn and the following permissible impurities of 0.5% of Si, 0.5% of Fe, 0.2% of Ti, 0.2% of Zn, 0.1% of Cu and 0.15% of others.

The aluminum support materials for printing plates, which are very frequently encountered in practice, are in general also roughened before application of the light-sensitive layer by mechanical (for example, by brushing and/or using treatments with abrasives), chemical (for example, by means of etching agents) or electrochemical (for example, by using an alternating current treatment in aqueous HCl or $HNO_3$ solutions) means. In particular, electrochemically roughened aluminum printing plates are preferably used for the present invention.

In general, the process parameters in the roughening stage are within the following ranges: the temperature of the electrolyte between 20° and 60° C., the active ingredient (acid or salt) concentration between 5 and 100 g/l, the current density between 15 and 130 A/dm$^2$, the residence time between 10 and 100 sec., and the electrolyte flow rate along the surface of the piece of material to be treated between 5 and 100 cm/sec. The current type usually used is alternating current, but modified current types are also possible, such as alternating current having differing current strength amplitudes for the anode current and cathode current.

The mean roughness depth $R_z$ of the roughened surface is here within a range of about 1 to 15 μm, in particular within a range of about 4 to 8 μm.

The roughness depth is determined in accordance with DIN 4,768 in the October 1970 version, and the roughness depth $R_z$ is then the arithmetic mean of the single roughness depths of 5 contiguous single measuring lengths. The single roughness depth is defined as the distance to the middle line of two parallel lines which, within the single measuring length, touch the roughness profile at the highest or the lowest point respectively. The single measuring length is the fifth part of the length, projected perpendicularly onto the middle line, of the part of the roughness profile directly used for evaluation. The middle line is the line parallel to the general direction of the roughness profile of the form of the geometrically ideal profile, which divides the roughness profile in such a way that the total of material-filled areas above the line and the total of material-free areas below the line are identical.

The electrochemical roughening process is then followed, in a further process stage to be optionally used, by an anodic oxidation of the aluminum, in order, for example, to improve the abrasion values and the adhesive properties of the surface of the support material. Customary electrolytes, such as $H_2SO_4$, $H_3PO_4$, $H_2C_2O_4$, amidosulfonic acid, sulfo-succinic acid, sulfo-salicylic acid or mixtures thereof, can be used in the anodic oxidation. The following examples of standard methods for the use of $H_2SO_4$-containing aqueous electrolytes for the anodic oxidation of aluminum may be pointed out (see on this point, for example, M. Schenck, "Werkstoff Aluminium und seine anodische Oxydation [Aluminum as a working material, and its anodic oxidation]", Francke Verlag - Berne, 1948, page 760; "Praktische Galvanotechnik [Practical electroplating and electroforming technology]", Eugen G. Leuze Verlag - Saulgau, 1970, page 395 et seq. and pages 518/519; and W. Huebner and C.T. Speiser, "Die Praxis der anodischen Oxidation des Aluminiums [The practice of anodic oxidation of aluminum]", Aluminium Verlag - Duesseldorf, 1977, 3rd edition, pages 137 et seq.):

The direct current/sulfuric acid process, in which anodic oxidation is carried out for 10 to 60 min. at 10° to 22° C. and a current density of 0.5 to 2.5 A/dm$^2$ in an aqueous electrolyte usually comprised of about 230 g of $H_2SO_4$ per liter of solution. In this process, the sulfuric acid concentration in the aqueous electrolyte solution can also be reduced down to 8 to 10% by weight of $H_2SO_4$ (about 100 g of $H_2SO_4$ per liter) or also increased to 30% by weight (365 g of $H_2SO_4$ per liter) and more.

The "hard anodizing" is carried out for 30 to 200 min. in an aqueous, $H_2SO_4$-containing electrolyte having a concentration of 166 g of $H_2SO_4$ per liter (or about 230 g of $H_2SO_4$ per liter) at an operating temperature of 0° to 5° C., at a current density of 2 to 3 A/dm$^2$, and at a potential increasing from about 25 to 30 V at the start to about 40 to 100 V toward the end of the treatment.

Apart from the processes already mentioned in the preceding paragraph for the anodic oxidation of printing plate support materials, there can also be used, for example, the following processes: the anodic oxidation of aluminum in an aqueous $H_2SO_4$-containing electrolyte, the $Al^{3+}$ ion content of which is adjusted to values of more than 12 g/l (according to German Offenlegungsschrift No. 2,811,396=U.S. Pat. No. 4,211,619), in an aqueous, $H_2SO_4$- and $H_3PO_4$-containing electrolyte (according to German Offenlegungsschrift No. 2,707,810=U.S. Pat. No. 4,049,504) or in an aqueous, $H_2SO_4$, $H_3PO_4$ and $Al^{3+}$ ion-containing electrolyte (according to German Offenlegungsschrift No. 2,836,803=U.S. Pat. No. 4,229,226). Direct current is preferably used for anodic oxidation, but it is also possible to use alternating current or a combination of these current types (for example, direct current with superposed alternating current). The layer weights of aluminum oxide vary within the range from about 1 to 10 g/m$^2$, corresponding to a layer thickness of about 0.3 to 3.0 μm.

Suitable light-sensitive layers are in principle all layers which, after exposure, if necessary with subsequent developing and/or fixing, provide an image-like surface which can be used for printing. The layers are applied to one of the customary support materials either by the manufacturer of pre-sensitized printing plates or directly by the consumer.

In addition to layers which contain silver halides, and which are used in many fields, various other layers are also known, such as those described, for example, in "Light-Sensitive Systems" by Jaromir Kosar, John Wiley & Sons Publishers, New York 1965: chromates- and dichromates-containing colloid layers (Kosar, chapter 2); layers which contain unsaturated compounds and in which these compounds, on exposure, are isomerized, rearranged, cyclized or crosslinked (Kosar, chapter 4); layers which contain photopolymerizable compounds and in which monomers or prepolymers polymerize on exposure, if necessary by means of an initiator (Kosar, chapter 5); and layers containing o-diazoquinones, such as naphthoquinonediazides, p-diazoquinones or diazonium salt condensates (Kosar, chapter 7). Suitable layers also include the electrophotographic layers, i.e., those which contain an inorganic or organic photoconductor. In addition to light-sensitive substances, these layers can of course also contain still other constitutents, such as, for example, resins, dyestuffs or plasticizers. In particular, the following light-sensitive compositions or compounds can be used in coating support materials manufactured by the process according to the invention.

Positive-working o-quinonediazide compounds, preferably o-naphthoquinonediazide compounds, described, for example, in German Pat. Nos. 854,890, 865,109, 879,203, 894,959, 938,233, 1,109,521, 1,144,705, 1,118,606, 1,120,273 and 1,124,817.

Negative-working condensation products of aromatic diazonium salts and compounds having active carbonyl groups, preferably condensation products of diphenylaminediazonium salts and formaldehyde, described, for example, in German Pat. Nos. 596,731, 1,138,399, 1,138,400, 1,138,401, 1,142,871 and 1,154,123, U.S. Pat. Nos. 2,679,498 and 3,050,502 and British Pat. No. 712,606.

Negative-working cocondensation products of aromatic diazonium compounds, for example, according to German Offenlegungsschrift No. 2,024,244, which have at least one unit each of the general types $A(-D)_n$ and B connected by a bivalent link derived from a carbonyl compound capable of condensation where these symbols are defined as follows: A is the radical of a compound which contains at least two aromatic carbocyclic and/or heterocyclic nuclei and which, in an acid medium, is capable of condensation with an active carbonyl compound at at least one position; D is a diazonium salt group bonded to an aromatic carbon atom of A; n is an integer from 1 to 10; and B is a radical of a compound which is free of diazonium groups and which, in an acid medium, is capable of condensation with an active carbonyl compound at at least one position of the molecule.

Positive-working layers according to German Offenlegungsschrift No. 2,610,842, which contain a compound which splits off acid on irradiation, a compound which has at least one C-O-C group which can be split off by acid (for example, an orthocarboxylate group or a carboxyamideacetal group) and, if appropriate, a binder.

Negative-working layers composed of photopolymerizable monomers, photoinitiators, binders and, if appropriate, other additives. Examples of the monomers here used are acrylates, methacrylates or products from reacting diisocyanates with partial esters of polyhydric alcohols, as described, for example, in U.S. Pat. Nos. 2,760,863 and 3,060,023 and German Offenlegungsschriften Nos. 2,064,079 and 2,361,041. Suitable photoinitiators include benzoin, benzoin ethers, polynuclear quinones, acridine derivatives, phenazine derivatives, quinoxaline derivatives, quinazoline derivatives and synergistic mixtures of various ketones. Examples of a large number of soluble organic polymers which can be used as binders are polyamides, polyesters, alkyd resins, polyvinyl alcohol, polyvinylpyrrolidone, polyethylene oxide, gelatin and cellulose ethers.

Negative-working layers according to German Offenlegungsschrift No. 3,036,077, which contain, as a light-sensitive compound, a diazonium salt polycondensation product or an organic azido compound and, as binder, a high-molecular polymer having lateral alkenylsulfonylurethane or cycloalkenylsulfonylurethane groups.

It is also possible to apply photosemiconducting layers as described, for example, in German Pat. Nos. 1,117,391, 1,522,497, 1,572,312, 2,322,046 and 2,322,047, to support materials manufactured according to the invention and thereby form highly light-sensitive, electrophotographic printing plates.

Coated offset printing plates obtained from the support materials according to the invention are converted in a known manner by imagewise exposure or irradiation and washing out of the non-image areas with a developer, preferably an aqueous developer solution, into the printing form desired. Surprisingly, offset printing plates, the base support materials of which have been treated according to the invention with the complex-type reaction products, are distinguished by a considerably improved hydrophilic character of the non-image areas and by increased practical light-sensitivity (better adhesion of the layer) over those plates in which the same base material has been treated with the corresponding polymers without reaction with metal cations having been carried out.

It has been found that, by means of the metal functions introduced into the polymer, the following advantageous effects on the properties of lithographic plates are obtained:

Owing to the water molecules bonded (even in the dried state) to the metal ion of the polymer-metal complex, the printing forms treated according to the invention have very good affinity for water (hydrophilic character) in the non-image areas. In printing, this results in a good ink-repellant action which, in the printing machine, leads to a rapid run-off from the plates.

Owing to the anchoring of the polymer chains in channels and pores of the aluminum oxide and to the additional interaction of the metal functions with the aluminum oxide and the insolubility of the polymer metal complexes in organic solvents and in neutral and alkaline aqueous media, the substances applied according to the invention to the base support adhere very well to the support, so that the original polymer-metal complex concentration on the support, and hence the hydrophilic character of the support, is substantially retained even after the developing process and during the printing process. The result is that the appearance of fogging phenomena during the printing process and after machine stoppages is substantially avoided.

Increased adhesion of the layers to the support is obtained through interactions of the metal functions of the polymer-metal complexes applied according to the invention to the base support with functional groups of the subsequently applied light-sensitive layers. This manifests itself in the increased practical light-sensitivity of negative-working layers as well as in increases in the print run for all types of light-sensitive layers used.

In the above descriptive section and in the examples which follow, % data, unless otherwise indicated, always are % by weight. Parts by weight relate to parts by volume as the g relates to the $cm^3$. For the rest, the following methods were used to determine the parameters in the examples.

The hydrophilic character of support materials manufactured according to the invention is tested by measuring the contact angle formed with a water droplet placed thereon. In this method, the angle formed between the support surface and a tangent passing through the contact point of the droplet is determined, the angle, in general, being between 0 and 90 degrees. The better the wetting is, the smaller the angle.

TEST OF THE RESISTANCE TO ALKALI OF THE SURFACE (according to U.S. Pat. No. 3,940,321, columns 3 and 4, lines 29 to 68 and lines 1 to 8)

The rate in sec. at which the layer dissolves in an alkaline zincate solution is taken as a measure for the alkali-resistance of an aluminum oxide layer. The longer dissolution takes, the more alkali-resistant is the layer. Layer thicknesses should be approximately comparable, since they, of course, also represent a parameter for the dissolution rate. A drop of a solution of 500 ml of distilled water, 480 g of KOH and 80 g of zinc oxide is supplied to the surface under test, and the time interval to the appearance of metallic zinc, recognizable as a black coloring of the test spot, is measured.

PREPARATION OF COMPLEX-TYPE REACTION PRODUCTS (POLYMER-METAL COMPLEXES)

Example 1

0.2 mole, relative to a vinylmethyl ether maleic anhydride unit, of the copolymer formed from vinylmethyl ether and maleic anhydride, was dissolved in 600 ml of water at 85° C. to 100° C. Thereby the anhydride groups were hydrolyzed to give free acids. 0.2 mole of Co $(NO_3)_2$, dissolved in 200 ml of water, was then slowly added dropwise to the solution. When the addition was complete, the mixture was stirred for a further hour. After the reaction solution had been cooled down to room temperature, it was neutralized by the slow addition of dilute aqueous NaOH solution, whereby the cobalt complex quantitatively precipitated as a viscous rubber-like pink-colored precipitate. This precipitate was filtered off, first washed with water and then with methanol, and dried at 60° C. in a drying cabinet, with excess $Co^{2+}$ ions remaining in the filtrate. It was possible, in the same way, to react also the other polymers containing maleic anhydride units with at least divalent metal cations.

Example 2

For the preparation of further polymer-metal complexes, the polymer employed in Example 1 was dissolved in a dilute aqueous $NH_3$ solution, whereby the maleic anhydride functions were hydrolyzed to give amide groups or semi-amide groups. The further reaction with the metal cation was performed as described in Example 1.

Example 3

For the preparation of the polymer-metal complexes of polyacrylic acid or polyacrylamide, the same procedure as in Example 1 was employed, except that the first hydrolysis step was omitted, i.e., the temperature was only 25° C.

PREPARATION OF OFFSET PRINTING PLATES

Example 4

A bright-rolled aluminum strip having a thickness of 0.3 mm was degreased with an aqueous alkaline 2% strength pickling solution at an elevated temperature of about 50° to 70° C. The aluminum surface was electrochemically roughened by means of alternating current in an $HNO_3$-containing electrolyte, with a surface roughness having an $R_z$ value of 6 μm being obtained. The subsequent anodic oxidation was carried out in an electrolyte containing sulfuric acid in a manner corresponding to the process described in German Offenlegungsschrift No. 2,811,396, the oxide weight being 3.0 $g/m^2$.

The aluminum strip thus pretreated was then passed through a warm bath at 60° C. which was comprised of an 0.5% strength solution (in 2% strength $H_3PO_4$) of the polymer-metal complex of the copolymer of vinyl methyl ether and maleic anhydride and $Al^{3+}$ ions. The residence time in the bath was 20 sec. In a rinsing step, excess solution was then removed with tap water, and the strip was dried with hot air at temperatures between 100° and 130° C.

To prepare lithographic printing plates, this support was coated with the following solution and dried:

- 0.7 part by weight of the polycondensation product of 1 mole of 3-methoxydiphenylamine-4-diazonium sulfate and 1 mole of 4,4'-bismethoxymethyl-diphenyl ether, precipitated as mesitylene sulfonate,
- 3.4 parts by weight of 85% strength phosphoric acid,
- 3.0 parts by weight of a modified epoxide resin obtained by reaction of 50 parts by weight of an epoxide resin having a molecular weight below 1,000 and 12.8 parts by weight of benzoic acid in ethylene glycol monomethyl ether in the presence of benzyltrimethylammonium hydroxide,
- 0.44 part by weight of finely ground Heliogen Blue G (C.I. 74,100),
- 62.0 parts by volume of ethylene glycol monomethyl ether,
- 30.6 parts by volume of tetrahydrofuran, and
- 8.0 parts by volume of ethylene glycol methyl ether acetate.

After exposure through a negative mask, developing was carried out with a developer solution comprised of

- 2.8 parts by weight of $Na_2SO_4 \cdot 10\ H_2O$,
- 2.8 parts by weight of $MgSO_4 \cdot 7\ H_2O$,
- 0.9 part by weight of orthophosphoric acid (85% strength),
- 0.08 part by weight of phosphorous acid,
- 1.6 parts by weight of nonionic wetting agent,
- 10.0 parts by weight of benzyl alcohol,
- 20.0 parts by weight of n-propanol, and
- 60.0 parts by weight of water.

The printing plate thus prepared could be developed quickly and haze-free. The non-image areas were distinguished by a very good ink-repellent action. Measurement of the contact angle formed with a water droplet produced, for decoated material, a value of 18°, and the print run was 200,000 copies.

Example 5

An aluminum strip treated in a manner corresponding to that of Example 4 was coated with the following solution:

6.6 parts by weight of cresol-formaldehyde novolak (having a softening range of 105°–120° C., according to DIN 53,181), 1.1 parts by weight of the 4-(2-phenylprop-2-yl)-phenyl ester of 1,2-naphthoquinone-2-diazide-4-sulfonic acid, 0.6 part by weight of 2,2'-bis-(1,2-naphthoquinone-2-diazide-5-sulfonyloxy-1,1'-dinaphthylmethane, 0.24 part by weight of 1,2-naphthoquinone-2-diazide-4-sulfonyl chloride, 0.08 part by weight of crystal violet, and 91.36 parts by weight of a solvent mixture of 4 parts by volume of ethylene glycol monomethyl ether, 5 parts by volume of tetrahydrofuran and 1 part by volume of butyl acetate.

The coated strip was dried in a drying duct at temperatures up to 120° C. Printing plates thus prepared were then exposed under a positive original and developed with a developer of the following composition:

5.3 parts by weight of sodium metasilicate . 9 $H_2O$, 3.4 parts by weight of trisodium phosphate . 12 $H_2O$, 0.3 part by weight of sodium dihydrogen phosphate (anhydrous), and 91.0 parts by weight of water.

The forms obtained were fault-free in copying and printing. The non-image areas had a very good ink-repellent action, which manifested itself in the printing machine in the rapid run-off from the form. The print run was 120,000 copies.

Examples 6 to 24 and comparative Examples C1 to C6

Sheet aluminum electrochemically roughened and anodized in accordance with Example 4 was dipped for 30 sec. at room temperature into one of the polymer-metal complex solutions (0.5% strength) listed below and containing phosphoric acid and dried. In each case one sample was coated with the light-sensitive layer of Example 4, and one sample was coated with the light-sensitive layer of Example 5. The results of the support investigations (measurement of the contact angle formed with water, zincate test) as well as of the copy, in comparison to samples which had been treated with the unreacted starting polymers, are listed in the table below. The print runs of the plates prepared according to the examples according to the invention correspond to the runs of comparative Example C6. In the table:

(1) means that the developability test was carried out by means of the light-sensitive layers (E4 and E5 respectively) used in Examples 4 and 5.

(2) means that the columns "Developability" and "Ink-repellent action" were evaluated in comparison to Example C6 (in accordance with German Pat. No. 1,621,478) considered the state of the art. Here:

— — means: very much worse than comparison C6

— means: worse than comparison C6 o means: corresponds to comparison C6

+ means: better than comparison C6

+ + means: very much better than comparison C6.

(3) means a copolymer of vinylmethyl ether and maleic acid anhydride (PVME/MAA)

(4) means a copolymer of ethylene and maleic acid anhydride (E/MAA)

(5) means polyacrylic acid (PAS)

(6) means polyacrylamide (PAA)

(7) means polyvinylphosphonic acid (PVPS).

| Example | Reaction product | | Contact angle (°) | Developability[1,2] | | Ink-repellant action | Zincate test (sec) |
|---|---|---|---|---|---|---|---|
| | Polymer | Metal ion | | E4 | E5 | | |
| 6 | PVME/MAA[3] | $Bi^{3+}$ | 25 | o | + | + | 41 |
| 7 | PVME/MAA | $Fe^{3+}$ | 22 | o | + | + | 56 |
| 8 | PVME/MAA | $Zr^{4+}$ | 21 | o | + | + | 58 |
| 9 | PVME/MAA | $Sn^{4+}$ | 20 | o | + | + + | 49 |
| 10 | PVME/MAA | $Ca^{2+}$ | 29 | o | o | o | 51 |
| 11 | PVME/MAA | $Co^{2+}$ | 31 | — | + | + | 52 |
| 12 | PVME/MAA | $Fe^{2+}$ | 29 | o | + | + | 52 |
| 13 | PVME/MAA | $Mn^{2+}$ | 15 | o | + | + + | 64 |
| V1 | PVME/MAA | — | 62 | — — | — | — | 45 |
| 14 | E/MAA[4] | $Al^{3+}$ | 21 | o | + | + | 56 |
| 15 | E/MAA | $Co^{2+}$ | 32 | — | o | + | 56 |
| 16 | E/MAA | $Fe^{2+}$ | 26 | o | + | + | 52 |
| 17 | E/MAA | $Mn^{2+}$ | 18 | o | + | + | 54 |
| 18 | E/MAA | $Zr^{4+}$ | 20 | o | + | + | 56 |
| V2 | E/MAA | — | 56 | — — | — | — | 45 |
| 19 | PAS[5] | $Al^{3+}$ | 25 | + | + | + | 56 |
| 20 | PAS | $Mn^{2+}$ | 19 | + | + | + | 57 |
| 21 | PAS | $Zn^{2+}$ | 22 | o | + | + | 54 |
| V3 | PAS | — | 41 | — | — | o | 43 |
| 22 | PAA[6] | $Al^{3+}$ | 29 | + | + | + | 87 |
| 23 | PAA | $Bi^{3+}$ | 15 | + | + | + | 68 |
| 24 | PAA | $Co^{2+}$ | 31 | o | + | + | 76 |
| V4 | PAA | — | 44 | — | o | — | 53 |
| V5 | untreated | | 81 | — — | — — | — — | 35 |
| V6 | PVPS[7] | — | 47 | o | o | o | 38 |

Example 25

Electrochemically flat-roughened ($R_z$=3 μm) and anodized sheet aluminum was after-treated and coated, both steps being carried out according to Example 13. The printing plates thus prepared were distinguished by the same advantages as indicated in Example 13.

Example 26

An aluminum support, roughened by brushing with an aqueous suspension of abrasive, was after-treated according to Example 23 and coated with the following solution:

0.6 part by weight of the diazonium salt condensation product indicated in Example 4, 0.06 part by weight of phosphoric acid (85% strength), 1.7 parts by weight of polyvinylformal (molecular weight 30,000, 7% of hydroxyl groups, 20 to 27% of acetate groups), 2.7 parts by weight of a dispersion of a copper naphthalocyanine pigment (C.I. 74,160) in ethylene glycol methyl ether acetate, and 95 parts by volume of ethylene glycol monomethyl ether.

Developing was carried out with the following solution:

5.7 parts by weight of $MgSO_4 . 7 H_2O$ 25.5 parts by weight of n-propanol, 1.1 parts by weight of ethylene glycol mono-n-butyl ester, 0.7 parts by weight of alkyl polyethoxyethanol, and 67.0 parts by volume of water.

Having the same copying properties as a support treated, according to German Pat. No. 1,134,093, with polyvinylphosphonic acid, the form thus prepared was distinguished by a markedly improved ink-repellent action of the non-image areas.

Example 27

Sheet aluminum treated according to Example 4 was coated with the following solution:

10 parts by weight of 2,5-bis-(bis-(4'-diethylaminophenyl)-1,3,4-oxadiazole, 10 parts by weight of a copolymer of styrene and maleic anhydride, having a mean molecular weight of 20,000 and an acid number of 180, 0.02 part by weight of Rhodamine FB (C.I. 45,170), in 300 parts by weight of a mixture of 3 parts by volume of tetrahydrofuran, 2 parts by volume of ethylene glycol monomethyl ether and 1 part by volume of butyl acetate.

The layer was negatively charged in the dark by means of a corona to about 400 V. The charged plate was imagewise exposed in a reprographic camera and then developed with an electrophotographic suspension developer prepared by dispersing 3.0 parts by weight of magnesium sulfate in a solution of 7.5 parts by weight of pentaerythritol resin ester in 1,200 parts by volume of an isoparaffin mixture having a boiling range of 185° to 210° C. After removal of excess developer liquid, the plate was dipped for 60 sec. into a solution of 35 parts by weight of sodium metasilicate . 9 $H_2O$, 140 parts by volume of glycerol, 550 parts by volume of ethylene glycol, and 140 parts by volume of ethanol.

The plate was then rinsed with a strong jet of water and the areas of the photoconductor layer not covered by toner were removed. The plate then was ready for printing. The offset form thus prepared had a very good ink-repellent action in the non-image areas.

Example 28

An aluminum strip prepared according to Example 18 was coated with a solution of 26.75 parts by weight of an 8% strength solution of the product from reacting a polyvinylbutyral having a molecular weight of 70,000 to 80,000 and comprising 71% by weight of vinylbutyral, 2% by weight of vinyl acetate and 27% by weight of vinyl alcohol units with propenylsulfonyl isocyanate, 2.14 parts by weight of 2,6-bis-(4-azidobenzene)-4-methylcyclohexanone, 0.23 part by weight of Rhodamine 6 GDN extra, and 0.21 part by weight of 2-benzoylmethylene-1-methyl-β-naphthothiazine in 100 parts by volume of ethylene glycol monomethyl ether and 50 parts by volume of tetrahydrofuran.

The dry weight was 0.75 g/m$^2$.

The light-sensitive layer was exposed for 35 sec. under a negative original to a 5 kW metal halide lamp. The exposed layer was treated, by means of a cotton pad, with a developer solution of the following composition:

5 parts by weight of sodium lauryl-sulfate, 1 part by weight of sodium metasilicate . 5 $H_2O$, and 94 parts by volume of water and the non-image areas were removed. The bared support areas had a very good ink-repellent action, which manifested itself in the printing machine in the rapid run-off from the printing plate. The run performance of the plate in a sheet-fed offset machine was 170,000 sheets.

Example 29

An aluminum sheet which had been electrochemically roughened and anodically oxidized in accordance with Example 4 was dipped for 30 sec. at 65° C. into a 1% strength aqueous solution of the copolymer of ethylene and maleic acid anhydride which had been hydrolyzed at 80° C. When the substrate was removed from the bath, excess solution was wiped off of the surface by means of a doctor blade. Then the still moist substrate was dipped for 30 sec. into a 2% strength aqueous solution of $Al(NO_3)_3 . 9 H_2O$ at room temperature, whereupon a rinsing step with tap water and drying with hot air (100° to 130° C.) followed. After this treatment, the substrate was coated with the light-sensitive solution described in Example 5, exposed and developed. The properties of the printing plate thus obtained were the same as those of the material produced in accordance with Example 5.

What is claimed is:

1. A web-shaped support material for offset printing plates, comprising a base layer comprised of aluminum or an aluminum alloy and having a roughened surface, and a hydrophilic coating of at least one salt-type hydrophilic organic polymer on the roughened surface of the base layer, wherein the salt-type hydrophilic organic polymer consists essentially of a complex-type product obtained by reacting (a) a water-soluble organic polymer have carboxylate substituents, carboxylic acid amide substituents and/or carboxylic acid imide substituents as functional groups selected from the group consisting of polyacrylic acid, a copolymer based on polyacrylic acid, polyacrylamide, a copolymer based on polyacrylamide, a hydrolyzed copolymer based on ethylene or vinylmethyl ether and maleic acid anhydride, a copolymer which has been partly or completely subjected to an ammonolysis with $NH_3$ and is based on ethylene or vinylmethyl ether and maleic acid anhydride, carboxyalkyl cellulose or the mixed ethers thereof, or one of the salts of these polymers with a monovalent cation; with (b) a salt of an at least divalent metal cation, and wherein the quantity of complex-type reaction product is less than about 0.1 mg per dm$^2$ of support material surface.

2. An offset printing plate, comprising a support material as defined by claim 1, and a layer of a light-sensitive material coated on the support material.

3. A support material for offset printing plates as claimed in claim 1, wherein one to three coordination sites of the metal cation are occupied by the functional groups of the polymer.

4. A support material for offset printing as claimed in claim 1, wherein the metal cation is di-, tri- or tetravalent.

5. A support material for offset printing plates as claimed in claim 4, wherein the metal cation comprises $Bi^{3+}$, $Al^{3+}$, $Fe^{3+}$, $Zr^{4+}$, $Sn^{4+}$, $Ca^{2+}$, $Ti^{3+}$, $Ba^{2+}$, $Sr^{2+}$, $Co^{2+}$, $Fe^{2+}$, $Mn^{2+}$, $Ni^{2+}$, $Cu^{2+}$, $Zn^{2+}$ or $Mg^{2+}$.

6. A support material for offset printing plates as claimed in claim 1, wherein the base layer further includes an aluminum oxide surface layer produced by anodic oxidation.

7. A support material for offest printing plates as claimed in claim 1, wherein the base layer is electrochemically roughened.

8. A process for manufacturing the support material for offset printing plates as claimed in claim 1, comprising the steps of applying a solution of the complex-type reaction product in an aqueous acid to at least one surface of the base layer, and drying the support material thus modified.

9. A process as claimed in claim 8, wherein the complex-type reaction product is dissolved in a concentration of from about 0.05 to 5% by weight in an aqueous acid having a strength of from about 0.1 to 10% by weight.

10. A process as claimed in claim 9, wherein the complex-type reaction product is dissolved in a concentration of from about 0.1 to 1% by weight in an about 0.5 to 3% by weight strength aqueous acid.

11. A process as claimed in claim 8, wherein the aqueous acid comprises phosphoric acid.

12. A process as claimed in claim 8, wherein the complex-type reaction product of the components (a) and (b) is formed on the support material.

13. A process as claimed in claim 12, which comprises dipping the support material in an aqueous solution of component (a) and subsequently in an aqueous solution of component (b).

14. A process as claimed in claim 13, wherein the aqueous solution of component (a) contains from about 0.2 to 10% by weight of component (a) and the aqueous solution of component (b) contains from about 0.1% by weight to the point of saturation of component (b).

* * * * *

UNITED STATES PATENT AND TRADEMARK OFFICE

CERTIFICATE OF CORRECTION

PATENT NO. : 4,427,766

DATED : January 24, 1984

INVENTOR(S) : Dieter MOHR

It is certified that error appears in the above-identified patent and that said Letters Patent is hereby corrected as shown below:

IN THE TITLE:

Line 2, kindly delete "POLYMER" and insert instead -- POLYMERS --.

IN THE CLAIMS:

Column 19, Claim 5, line 10, kindly delete "$Ca^{2°}$" and insert instead -- $Ca^{2+}$ --.

Signed and Sealed this

*Twenty-sixth* Day of *June 1984*

[SEAL]

*Attest:*

GERALD J. MOSSINGHOFF

*Attesting Officer*

*Commissioner of Patents and Trademarks*